US005218837A

United States Patent [19]

Moore

[11] Patent Number: 5,218,837

[45] Date of Patent: Jun. 15, 1993

[54] CONTROL SYSTEM FOR CONTROLLING THE OPERATION OF AN AIR CONDITIONING COMPRESSOR AND METHOD OF MAKING THE SAME

[75] Inventor: Dwain F. Moore, Holland, Mich.

[73] Assignee: RobertShaw Controls Company, Richmond, Va.

[21] Appl. No.: 905,253

[22] Filed: Jun. 26, 1992

[51] Int. Cl.[5] ..... G05D 23/32

[52] U.S. Cl. ..... 62/228.3; 62/158; 62/229

[58] Field of Search ..... 62/228.3, 158, 126, 62/127, 129, 229, 228.1

[56] References Cited

U.S. PATENT DOCUMENTS 3,289,429 12/1966 Beard ..... 62/227 X
3,636,369 1/1972 Harter ..... 62/158 X
3,792,592 2/1974 Cook ..... 62/158
4,602,484 7/1986 Bendikson ..... 62/158

*Primary Examiner*—Harry B. Tanner
*Attorney, Agent, or Firm*—Candor, Candor & Tassone

[57] ABSTRACT

A control system for controlling the operation of an air conditioning compressor and method of making the same are provided, the system comprising a thermostat switch and a high pressure switch arranged in series with a compressor switch across two sides of a power source whereby the thermostat switch and the high pressure switch must be in a closed condition thereof with the compressor switch also being in a closed condition before the compressor can be turned on, the system also comprising a low pressure switch that is arranged so as not to be in series with the other switches across the two sides of the power source and a microprocessor having means operatively associated with the low pressure switch to monitor the condition thereof.

8 Claims, 2 Drawing Sheets

CONTROL SYSTEM FOR CONTROLLING THE OPERATION OF AN AIR CONDITIONING COMPRESSOR AND METHOD OF MAKING THE SAME

BACKGROUND OF THE INVENTION

1. Field of the Invention

This invention relates to a new control system for controlling the operation of an air conditioning compressor means as well as to a new method of making such a control system.

2. Prior Art Statement

It is known to provide a control system for controlling the operation of an air conditioning compressor means that has a refrigerant high pressure side and a refrigerant low pressure side, the system having a compressor switch means for turning on the compressor means when the compressor switch means is closed, a microprocessor means operatively associated with the compressor switch means and having means to control the opening and closing of the compressor switch means, a thermostat switch means operatively associated with the compressor switch means so as to prevent operation of the compressor means unless the thermostat switch means is closed, a high pressure switch means operatively interconnected to the high pressure side of the compressor means and operatively associated with the compressor switch means, and a low pressure switch means operatively interconnected to the low pressure side of the compressor means and operatively associated with the compressor switch means, the thermostat switch means and the high pressure switch means being arranged to be in series with the compressor switch means across two sides of a power source whereby the thermostat switch means and the high pressure switch means must be in a closed condition thereof when the compressor switch means is in a closed condition before the compressor means can be turned on, the low pressure switch means also being in series with the thermostat switch means and the high pressure switch means so that the low pressure switch means must also be in a closed condition thereof before the compressor means can be turned on.

SUMMARY OF THE INVENTION

It is one of the features of this invention to provide a new control system for controlling the operation of an air conditioning compressor means wherein the low pressure switch means does not have to be in a closed condition thereof upon each initial start up of the compressor means in each cycle of operation thereof.

In particular, it was found according to the teachings of this invention that when each of the prior known control systems for controlling the operation of an air conditioning compressor means is utilized in a roof top installation thereof and is to be operated on a cold day, the low pressure switch may not initially close for a certain time period even though the compressor means has sufficient refrigerant for proper compressor operation. This is particularly a problem where it is desired to run the air conditioning system for a short period of time even though it is a cold day. For example, a restaurant may have a hot kitchen on such a cold day so that it is desired to operate the air conditioning system for a short period of time to cool down such kitchen. However, because of the cold day, and particularly with the roof top installation of the air conditioning unit, the low pressure switch will not initially close so the air conditioning system can not be operated for its intended purpose.

Therefore, it was found according to the teachings of this invention that the low pressure switch could be arranged in the control system in such a manner that the operation of the low pressure switch could be ignored on an initial start up cycle of the air conditioning control system for a certain period of time after which if the low pressure switch does not close, then the control system will shut down.

In particular, it was found according to the teachings of this invention that the low pressure switch does not need to be in a series with the high pressure switch and the compressor switch as in the prior known control systems but can be in parallel therewith and be monitored by a microprocessor which will turn off the compressor means if the low pressure switch does not close within a certain delayed time period after the initial closing of the thermostat switch means.

For example, one embodiment of this invention provides a control system for controlling the operation of an air conditioning compressor means that has a refrigerant high pressure side and a refrigerant low pressure side, the system having a compressor switch means for turning on the compressor means when the compressor switch means is closed, a microprocessor means operatively associated with the compressor switch means and having means to control the opening and closing of the compressor switch means, a thermostat switch means operatively associated with the compressor switch means so as to prevent operation of the compressor means unless the thermostat switch means is closed, a high pressure switch means operatively interconnected to the high pressure side of the compressor means and operatively associated with the compressor switch means, and a low pressure switch means operatively interconnected to the low pressure side of the compressor means and operatively associated with the compressor switch means, the thermostat switch means and the high pressure switch means being arranged to be in series with the compressor switch means across two sides of a power source whereby the thermostat switch means and the high pressure switch means must be in a closed condition thereof with the compressor switch means being in a closed condition before the compressor means can be turned on, the low pressure switch means being arranged so as not to be in series with the other switch means across the two sides of the power source, the microprocessor means having means operatively associated with the low pressure switch means to monitor the condition thereof.

Accordingly, it is an object of this invention to provide a new control system for controlling the operation of an air conditioning compressor means, the control system of this invention having one or more of the novel features of this invention as set forth above or hereinafter shown or described.

Another object of this invention is to provide a new method of making such a control system, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein.

DESCRIPTION OF THE PREFERRED EMBODIMENT

Figure 1:
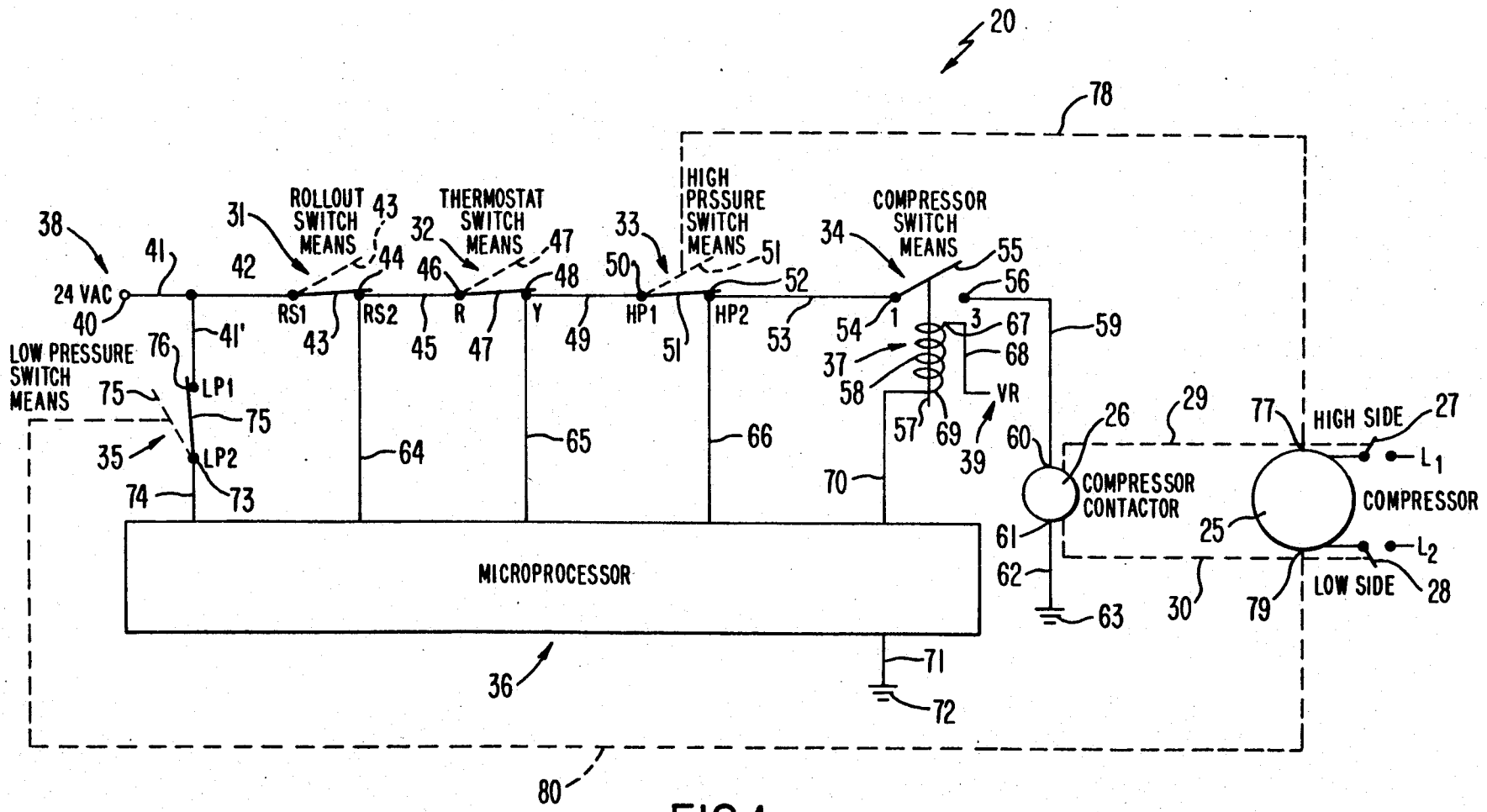
FIG. 1 is a schematic view illustrating the new control system of this invention.

While the various features of this invention are hereinafter illustrated and described as being particularly adapted to provide a control system for an air conditioning compressor means, is to be understood that the various features of this invention can be utilized singly or in various combinations thereof to provide a control system for other apparatus as desired.

Therefore, this invention is not to be limited to only the embodiment illustrated in the drawings, because the drawings are merely utilized to illustrate one of the wide variety of uses of this invention.

Figure 2:
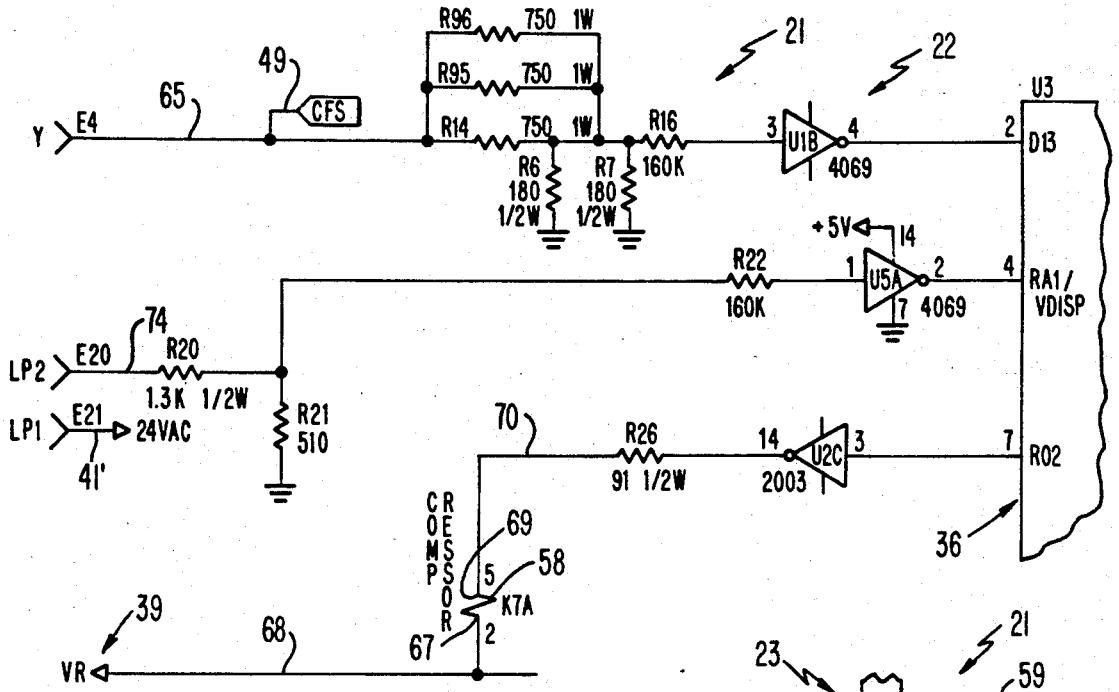
FIG. 2 is a fragmentary view illustrating part of the electrical system of the control system of FIG. 1.
Figure 3:
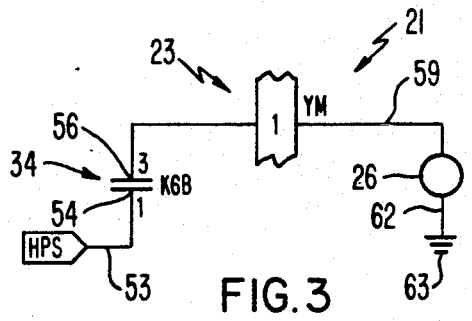
FIG. 3 is another fragmentary view of part of the electrical system of the control system of FIG. 1.
Figure 4:
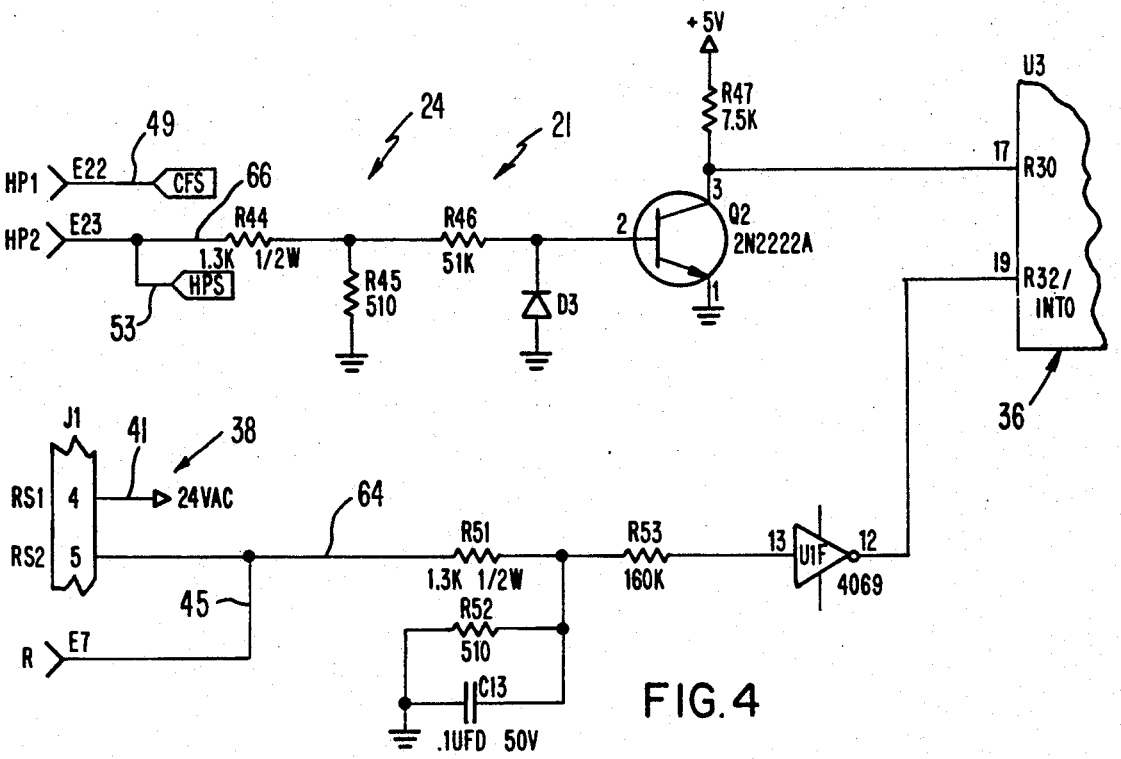
FIG. 4 is another fragmentary view of the electrical system for the control system of FIG. 1.

Referring now to FIG. 1, the new control system of this invention for controlling the operation of an air conditioning compressor means is generally indicated by the reference numeral 20 and one working embodiment of the electrical circuit means of the system 20 of FIG. 1 is generally indicated by the reference numeral 21 in FIGS. 2-4, FIG. 2 illustrating a portion 22 of the circuit means 21, FIG. 3 illustrating a portion 23 of the circuit means 21 and FIG. 4 illustrating a portion 24 of the circuit means 21 as will be apparant hereinafter. It is to be understood that the electrical circuit means 21 could also have portions (not shown) that would control a heating unit, if desired.

As illustrated in FIG. 1, the control system 20 of this invention controls the operation of a compressor 25 of an air conditioning unit (not shown) for cooling one or more rooms of a building or other structure (not shown) in a manner well known in the art, the compressor 25 being of the conventional type for circulating a refrigerant in a well known manner and being electrically operated by having power source leads L1 and L2 interconnected thereto when a compressor contactor 26 is operated in a manner hereinafter set forth to close switch means 27 and 28 respectively for the power source leads L1 and L2 in a manner well known in the art when the compressor contactor 26 is placed across a power source and thereby closes the switch means 27 and 28 through respective interconnection means 29 and 30. The compressor contactor 26 will open the switch means 27 and 28 to terminate the electrical connection of the compressor 25 with the power source leads L1 and L2 when the compressor contactor 26 is disconnected from across its power source as will be apparant hereinafter.

The control system 20 comprises a rollout switch means that is generally indicated by the reference numeral 31, a thermostat switch means that is generally indicated by the reference numeral 32, a high pressure switch means that is generally indicated by the reference numeral 33, a compressor switch means that is generally indicated by the reference numeral 34, a low pressure switch means that is generally indicated the reference numeral 35, a microprocessor that is generally indicated by the reference numeral 36, a relay means that is generally indicated by the reference numeral 37, a 24 volt alternating current source that is generally indicated by the reference numeral 38 and another voltage source that is generally indicated by the reference numeral 39 and also by the reference letters "VR" in FIGS. 1 and 2.

As illustrated in FIG. 1 the active side of the 24 volt alternating current source 38 is interconnected to a contact or terminal 40 at one end of an electrical lead means 41 that has its other end interconnected to a contact 42 of the rollout switch means 31, the rollout switch means 31 having a movable contact blade or arm 43 that is adapted to electrically interconnect the contact 42 with a contact when the rollout switch means 43 is closed as illustrated by full lines in FIG. 1. The contacts 42 and 44 of the rollout switch means 31 are also designated respectively as RS1 and RS2 in FIGS. 1 and 4.

The contact 44 of the rollout switch means 31 is electrically interconnected by an electrical lead means 45 to a contact 46 of the thermostat switch means 32 which has a movable switch blade or arm 47 that is adapted to electrically interconnect the contact 46 with a contact 48 when the switch blade 47 is disposed in a closed condition as illustrated by full lines in FIG. 1. The contacts 46 and 48 of the thermostat switch means 32 are also respectively designated as R and Y in FIGS. 1, 2 and 4.

The contact 48 of the thermostat switch means 32 is electrically interconnected by an electrical lead means 49 to a contact 50 of the high pressure switch means 33, the high pressure switch means 33 having a movable switch arm or blade 51 that is adapted to close against another contact 52 thereof in the manner illustrated by full lines in FIG. 1 to electrically interconnect the contact 50 with the contact 52. The contacts 50 and 52 of the high pressure switch means 33 are also respectively designated HP1 and HP2 in FIGS. 1 and 4.

The contact 52 of the high pressure switch means 33 is electrically interconnected by an electrical lead means 53 to a contact 54 of the compressor switch means 34, the compressor switch means 34 having a movable contact arm 55 that is adapted to be closed against a contact 56 to electrically interconnect the contacts 54 and 56 together when an armature 57 of the contact arm 55 is pulled downwardly in FIG. 1 by an energized coil 58 of the relay means 37 in a manner well known in the art. The contacts 54 and 56 of the compressor switch means 34 are also respectively designated as 1 and 3 in FIGS. 1 and 3 and the compressor switch means 34 is also designated as K6B in FIG. 3. Of course, when the relay coil 58 is de-energized, the armature 57 is moved upwardly by spring means (not shown) to open the switch arm 55 away from the contact 56 so that the compressor switch means will be held in an open condition as is well known in the art.

The contact 56 of the compressor switch means 34 is electrically interconnected by an electrical lead means 59 to one side 60 of the compressor contactor 26 while another side 61 of the compressor contactor 26 is interconnected by a lead means 62 to ground 63.

Therefore, it can be seen that the rollout switch means 31, the thermostat switch means 32, the high pressure switch means 33 and the compressor switch means 34 are disposed in series between the active side of the VAC source 38 and the ground 63 so that the rollout switch means 31, the thermostat switch means 32, the high pressure switch means 33 and the compressor switch means 34 must all be in a closed condition before the compressor contactor can be energized to close the switch means 27 and 28 in order to operate the refrigerant compressor 25 with the power source L1 and L2.

The microprocessor 36 monitors the contact 44 of the rollout switch means 31 by means of an electrical lead means 64 as illustrated in FIGS. 1 and 4. The microprocessor 36 monitors the contact 48 of the thermostat switch means 32 by means of an electrical lead means 65 that is illustrated in FIG. 1 and FIG. 2. The microprocessor 36 monitors the contact 52 of the high pressure switch means by means of an electrical lead means 66 that is illustrated in FIG. 1 and FIG. 4.

The active side of the power source 39 is interconnected to one end 67 of the relay coil 58 by an electrical lead means 68 as illustrated in FIG. 1 and FIG. 2 while the other end 69 of the relay coil 58 is interconnected by a lead means 70 to the microprocessor 36 as illustrated in FIG. 1 and FIG. 2, the microprocessor 36 having means (not shown) for interconnecting the lead 70 to a lead means 71 that is interconnected to ground 72 as illustrated in FIG. 1.

The low pressure switch means 35 has a contact 73 that is electrically interconnected to the microprocessor 36 by an electrical lead means 74. The low pressure switch means has a movable contact arm or blade 75 that is adapted to close against a contact 76, to electrically interconnect the lead means 74 with another lead means 41' that is interconnected to the lead means 41 as illustrated in FIG. 1. The contacts 76 and 73 of the low pressure switch means 35 are also respectively designated LP1 and LP2 in FIG. 1 and FIG. 2 and the lead means 74 and 41' are also illustrated in FIG. 1 and FIG. 2.

The high pressure switch means 33 and the low pressure switch means 35 are of conventional structure that is well known in the art, the high pressure switch means 33 normally having its contact arm 51 disposed in the closed condition illustrated by full lines in FIG. 1 and will open only when the pressure value of the refrigerant at a high side 77 in the compressor 25 has exceeded a certain value to operate the switch arm 51 to an open condition through interconnection means 78 that is schematically illustrated in FIG. 1.

In contrast, the low pressure switch means 35 has the contact arm 75 normally disposed in an open condition and will only close against the contact 76 when the pressure value of the refrigerant in the compressor 25 at a low side 79 thereof decreases to a certain value by the normal operation of the compressor 25, the low side 79 of the compressor 25 being interconnected to the low pressure switch arm 75 by interconnection means 80 that is schematically illustrated in FIG. 1.

Therefore, it can be seen that the low pressure switch means 35 of this invention is uniquely located in the control system 20 so as not to be in a series with the thermostat switch means 32, the high pressure switch means 33 and the compressor switch means 34 but is adapted to be, in effect, placed parallel across the active side of the power source 38 and the ground 72 by the microprocessor 36 whereby the microprocessor 36 monitors the open and closed conditions of the low pressure switch means 35 for a purpose hereinafter said forth.

The thermostat means 32 has its switch arm or blade 47 moved to the closed condition against the contact 48 when a suitable thermostat (not shown) senses that the temperature being sensed thereby is above the temperature setting thereof when the thermostat is set for an air conditioning operation as opposed to a heating operation, the thermostat opening the switch means 32 by moving the switch arm 47 away from the contact 48 as illustrated in dashed lines in FIG. 1 when the temperature being sensed by the thermostat falls below the selected temperature of the thermostat.

Accordingly, the microprocessor 36 is so programmed in a manner well known in the art that the microprocessor 36 will not energize the relay coil 58 unless the microprocessor 36 senses that the rollout switch means 31, the thermostat switch means 32 and the high pressure switch means 33 are all disposed in the closed condition thereof upon the initial closing of the thermostat switch means 32 as the microprocessor 36 monitors the condition of the rollout switch means 31 through the lead means 64, the thermostat switch means 32 through the lead means 65 and the high pressure switch means 33 through the leads means 66 whereby the microprocessor 36 interconnects the side 69 of the relay coil 58 with the ground 72 through the lead means 71 so that the energized coil 58 will pull the armature 57 downwardly in FIG. 1 and thereby close the switch arm 55 of the compressor switch means 34 against the contact 56 so that the compressor contactor 26 is placed across the power source 38, 63 to cause the compressor 25 to be turned on and begin to cool the area being controlled by the thermostat of the thermostat switch means 32.

The microprocessor 36 is also so programmed in a manner well known in the art that upon the initial cycle of the operation of the compressor 25, the low pressure switch 35 can be in an open condition as illustrated by the dashed lines for the arm 75 thereof and should the arm 75 remain in an open condition for a certain time period, such as three minutes, the microprocessor 36 will continue to have the compressor switch means 34 maintained in its closed condition by continuously maintaining the energization of the relay coil 58. However, if after the lapse c,f that predetermined time period, such as the aforementioned three minutes, should the contact 75 of the low pressure switch means 35 not close against the contact 76 as determined by the microprocessor 36 monitoring the condition of the low pressure switch means 35 through the lead means 74, the microprocessor 36 will open the compressor switch means 34 by de-energizing the relay coil means 58 and thereby terminate the operation of the compressor 25.

However, if during that predetermined time period, such as the aforementioned three minutes, the low pressure switch arm 75 closes against the contact 76 and remains closed against the same, the microprocessor 36 will continue to operate the relay means 37 so that the compressor 25 will continue to operate until the thermostat switch means 32 opens and thereby indicate that the temperature has now fallen to the selected temperature whereby the operation of the compressor 25 ceases until the thermostat switch means again closes as previously set forth.

The microprocessor 36 is also programmed in a manner well known in its art that if at any time during an initial cycle of operation of the compressor 25 and should the low pressure switch arm 75 be in a closed condition initially and then open or should be in an initial open condition and then close during that predetermined time period and then open before the end of that predetermined time period, the microprocessor 36 will de-energize the relay coil 58 to cause the compressor switch means 34 to move to an open condition and thereby terminate the operation of the compressor 25.

As previously stated, the above described operation of the control system 20 of this invention permits the control system 20 to operate an air conditioning unit that is mounted on a roof top or the like and permits a user of the control system 20 to cool a room or area in the building of the roof top installation even though it is a cold day and initially the low side 79 of the compressor does not create a sufficient negative pressure to close the low pressure switch means 35 until after the compressor 25 has been operating for a certain period of time even though there is sufficient refrigerant for the compressor 25 to run properly. This permits a restaurant that has a hot kitchen to cool down that kitchen even though it is a cold day outside which with a prior known control system that has the low pressure switch means thereof in series with the high pressure switch means thereof so that the resulting open low pressure switch means would not permit the compressor of such prior known control system to operate on that cold day.

While the operation of and the method of making the control system 20 of this invention as previously described if fully understandable from the schematic showing in FIG. 1 and from the previous detailed description thereof, one working embodiment of the control system 20 of this invention in regards to the electrical circuit means 21 thereof is illustrated in FIGS. 2, 3, and 4 wherein, unless otherwise specified in FIGS. 2, 3, and 4, all resistor values are in ohmns, 0.25 watt, plus/-minus 5%; all capacitor values are 50 V plus/minus 20% and all diodes are 1N4148. Also, it can be seen that in FIGS. 2, 3 and 4 all electrical components are illustrated in a conventional manner so that a detailed description thereof is not necessary as the same are fully understandable to a person skilled in this art.

All illustrated in FIG. 2, the circuit portion 22 of the circuit means 21 of this invention has a pair of terminals E20 and E21 respectively interconnected to the lead means 74 and 41' as well as to the contacts 73 and 76 of the low pressure switch means 35, the contacts 73 and 76 of the low pressure switch means being designated LP2 and LP1 as previously described. The lead means 74 is interconnected to a port 4 of the microprocessor 36 which is also given the designation U3 in FIGS. 2 and 4.

Since the electrical components that are illustrated in the lead 74 are well known components in the art, as well as in the other lead means 65, 68, 66 and 64, a specific reference to the various resistors, diodes, etc. need not be made in this description.

As illustrated in FIG. 2, the active side of the power source 39 is interconnected by the lead 68, the relay coil 58 and the lead means 70 to the port 7 of the microprocessor 36, the power source 39 also being designated as VR in FIG. 2.

Also illustrated in FIG. 2, the lead means 65 has a terminal E4 which is interconnected to the contact 48 of the thermostat switch means 32 which in FIG. 2 is designated as Y as previously stated, the lead means 65 being interconnected to the port 2 of the microprocessor 36.

The lead means 64 as illustrated in FIG. 4 is interconnected through the lead 45 to a terminal E7 which in turn is interconnected to the contact 46 of the thermostat switch means 32 which is designated as R in FIG. 4 as previously stated. In addition, the lead 64 is interconnected at a connector J1 to the contact 44 of the rollout switch means 31 which is designated as RS2 in FIG. 4 while the other end of the lead means 64 is interconnected to a port 19 of the microprocessor 36.

As also illustrated in FIG. 4, the active side of the power source 38 is interconnected by the lead means 41 to the connector J1 at a point thereof that is also interconnected to the contact 42 of the rollout switch means 31 which is designated as RS1 in FIG. 4 as previously described, the power source 38 also being designated as 24 VAC in FIG. 4.

As illustrated in FIG. 4, the circuit portion 24 has two terminals E22 and E23 respectively interconnected to the terminals 50 and 52 of the high pressure switch means 33 with such contacts 50 and 52 being designated as HP1 and HP2 respectively in FIG. 4. The terminal E23 of FIG. 4 is effectively interconnected to the port 17 of the microprocessor 36 by the lead means 66.

As illustrated in FIG. 4, the terminal E23 or the contact 52 of the high pressure switch 33 is interconnected by the lead means 53 to the contact 54 of the compressor switch means 34 as illustrated in FIG. 3 wherein the ends HPS are interconnected together to complete the lead means 53 as illustrated, the contact 54 of the compressor switch means 34 also being designated as 1 in FIGS. 1 and 3.

As illustrated in FIG. 4, the terminal E22 for the contact 50 of the high pressure switch means 33 is interconnected to the lead means 49 that joins with the contact or terminal E4 for the contact 48 of the thermostat switch means 32 through the interconnections CFS illustrated repectively in FIG. 4 and FIG. 2.

Thus, it can be seen that the electrical circuit means 21 of the one working embodiment of the control system 20 of this invention can be provided with various electrical components interconnected together so as to form the schematic control system 20 illustrated in FIG. 1 that operates in a manner now to be described.

Normally the switch arm 47 of the thermostatic switch means 32 is an open condition and will close when the sensing means of the thermostat switch means senses that the temperature being sensed thereby is above the selected temperature of the thermostat switch means in a manner well known in the art. Thus, as long as the thermostat switch means 32 is in an open condition, the microprocessor 36 does not cause the relay coil means 58 to be energized so that the compressor switch means 34 has its switch arm 55 in the open condition as illustrated and thereby the compressor contactor 26 maintains the switch means 27 and 28 for the compressor 25 in the open condition as illustrated. Thus the compressor 25 is not operating at this time.

The low pressure switch means 35 has the switch arm 75 thereof normally opened but will close within a few seconds of operation of the compressor 25. However, if the refrigerant at the low side 79 of the compressor 25 is too cold, the low pressure switch means 35 remains in an open condition thereof even if the component 25 is operating for one or more minutes. As previously stated, this condition of an open switch means 35 can occur if the compressor 25 is mounted on a rooftop and the same is in a cold environment, such as caused by a cold day.

In contrast, the high pressure switch means 33 is normally in a closed condition thereof and only opens if the refrigerant pressure at the high side 77 of the compressor 25 exceeds a certain value during operation of the compressor 25.

Thus, assuming that the compressor 25 is to operate on a cold day whereby the low pressure switch means 35 is in an open condition thereof, the set point for the thermostat switch means can be set to a temperature setting that is below the temperature being sensed by the thermostat switch means so that the thermostat switch means 32 closes. The microprocessor 36 will energize the relay coil means 58 if the other switch means 31 and 33 are also in a closed condition when the thermostat switch means 32 closes. The closing of the compressor switch means 34 by the energized relay coil means 58 causes the compressor contactor 26 to close the switch means 27 and 28 for the compressor 25 to interconnect the compressor 25 to the power source leads L1 and L2 whereby the compressor 25 will now be operating to cool the desired building space.

However, because it is a cold day, the low pressure switch means 35 is in an open condition but the microprocessor 36 has been so programmed that the same will not cause the compressor switch means 34 to open unless the low pressure switch means 35 is not closed within a predetermined delay time period, such as the aforementioned three minutes, so that the compressor 25 can deliver cold air to the area where the thermostat of the thermostat switch means 32 is located.

If upon the initial operation of the compressor 25 by the initial closing of the thermostat switch means 32, the low pressure switch means 35 is in a closed condition thereof and thereafter should the low pressure switch means 35 open or if the low pressure switch means 35 is initially in an open position and closes so that a subsequent opening of the switch means 35 takes place, even though that subsequent opening is within the predetermined time delay period of three minutes, the microprocessor 36 will terminate the operation of the relay coil means 58 so that the compressor switch means 34 will open and terminate the operation of the compressor 25 as such operation of the low pressure switch means 35 indicates a malfunction condition for the compressor 25.

Therefore it can be seen that this invention not only provides a new control system for controlling the operation of an air conditioning compressor means, but also this invention provides a new method of making such a control system.

While the forms and methods of this invention now preferred have been illustrated and described as required by the Patent statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control system for controlling the operation of an air conditioning compressor means that has a refrigerant high pressure side and a refrigerant low pressure side, said system having a compressor switch means for turning on said compressor means when said compressor switch means is closed, a microprocessor means operatively associated with said compressor switch means and having means to control the opening and closing of said compressor switch means, a thermostat switch means operatively associated with said compressor switch means so as to prevent operation of said compressor means unless said thermostat switch means is closed, a high pressure switch means operatively interconnected to said high pressure side of said compressor means and operatively associated with said compressor switch means, and low pressure switch means operatively interconnected to said low pressure side of said compressor means and operatively associated with said compressor switch means, said thermostat switch means and said high pressure switch means being arranged to be in series with said compressor switch means across two sides of a power source whereby said thermostat switch means and said high pressure switch means must be in a closed condition thereof with said compressor switch means being in a closed condition before said compressor means can be turned on, the improvement wherein said low pressure switch means is arranged so as not to be in series with the other said switch means across said two sides of said power source and wherein said microprocessor means has means operatively associated with said low pressure switch means to monitor the condition thereof, said microprocessor means having means to open said compressor switch means if said low pressure switch means does not initially close within a predetermined time period after the initial closing of said thermostat switch means on each cooling cycle of said system, said microprocessor means having means to immediately open said compressor switch means if said low pressure switch means is initially closed and subsequently opens or is closed sometime during said predetermined time period and then subsequently opens even if the subsequent opening of said low pressure switch means takes place during said predetermined time period.

2. A system as set forth in claim 1 wherein said low pressure switch means is arranged to interconnect one of said sides of said power source to said microprocessor means when said low pressure switch means is closed.

3. A system as set forth in claim 1 wherein said predetermined time period is approximately three minutes.

4. A system as set forth in claim 1 wherein said microprocessor means has a portion thereof arranged in series with said low pressure switch means across said two sides of said power source.

5. In a method of making a control system for controlling the operation of an air conditioning compressor means that has a refrigerant high pressure side and a refrigerant low pressure side, said system having a compressor switch means for turning on said compressor means when said compressor switch means is closed, a microprocessor means operatively associated with said compressor switch means and having means to control the opening and closing of said compressor switch means, a thermostat switch means operatively associated with said compressor switch means so as to prevent operation of said compressor means unless said thermostat switch means is closed, a high pressure switch means operatively interconnected to said high pressure side of said compressor means and operatively associated with said compressor switch means, and a low pressure switch means operatively interconnected to said low pressure side of said compressor means and operatively associated with said compressor switch means, said thermostat switch means and said high pressure switch means being arranged to be in series with said compressor switch means across two sides of a power source whereby said thermostat switch means and said high pressure switch means must be in a closed condition thereof with said compressor switch means being in a closed condition before said compressor means can be turned on, the improvement comprising the steps of arranging said low pressure switch means so as not to be in series with the other said switch means across said two sides of said power source, forming said microprocessor means to have means operatively associated with said low pressure switch means so as to monitor the condition thereof, forming said microprocessor means to have means to open said compressor switch means if said low pressure switch means does not initially close within a predetermined time period after the initial closing of said thermostat switch means on each cooling cycle of said system, and forming said microprocessor means to have means to immediately open said compressor switch means if said low pressure switch means is initially closed and subsequently opens or is closed sometime during said predetermined time period and then subsequently opens even if the subsequent opening of said low pressure switch means takes place during said predetermined time period.

6. A method as set forth in claim 5 and comprising the step of arranging said low pressure switch means so as to interconnect one of said sides of said power source to said microprocessor means when said low pressure switch means is closed.

7. A method as set forth in claim 5 wherein said predetermined time period is approximately three minutes.

8. A method as set forth in claim 5 and comprising the step of forming said microprocessor means to have a portion thereof arranged in series with said low pressure switch means across said two sides of said power source.

* * * * *